US007557283B1

(12) United States Patent
Moncrief

(10) Patent No.: US 7,557,283 B1
(45) Date of Patent: Jul. 7, 2009

(54) GUITAR SLIDE

(76) Inventor: Frank N. Moncrief, 70 Chadd's Pointe, Acworth, GA (US) 30101

( * ) Notice: Subject to any disclaimer, the term of this patent is extended or adjusted under 35 U.S.C. 154(b) by 0 days.

(21) Appl. No.: 11/755,438

(22) Filed: May 30, 2007

(51) Int. Cl.
*G10D 3/00* (2006.01)

(52) U.S. Cl. ..... 84/319; 84/453

(58) Field of Classification Search ..... 84/319, 84/315, 322, 395, 453, 485 R
See application file for complete search history.

(56) References Cited

U.S. PATENT DOCUMENTS

| | | | | |
|---|---|---|---|---|
| 3,943,815 | A | 3/1976 | Gilbert | |
| 3,958,113 | A | 5/1976 | Termohlen | |
| 4,563,933 | A | 1/1986 | Kim | |
| 4,704,941 | A | 11/1987 | Reilly | |
| 5,631,435 | A | 5/1997 | Hutmacher | |
| 6,162,975 | A * | 12/2000 | Purdue | 84/395 |
| D440,001 | S | 4/2001 | Marcella | |
| 6,323,409 | B1 | 11/2001 | Surber | |
| 6,626,728 | B2 * | 9/2003 | Holt | 446/219 |
| 6,908,206 | B1 | 6/2005 | Pinciaro | |
| 2003/0209131 | A1 * | 11/2003 | Asahi | 84/485 R |
| 2007/0028746 | A1 * | 2/2007 | Herring | 84/322 |

* cited by examiner

*Primary Examiner*—Jeffrey Donels
*Assistant Examiner*—Jianchun Qin
(74) *Attorney, Agent, or Firm*—Womble Carlyle Sandridge & Rice, PLLC

(57) ABSTRACT

A musical instrument slide including a body portion and a light source. The light source includes a switch for selective activation, enabling the slide body to emit light when activated. As the musician moves the slide across the strings as the instrument, such as a guitar, is played, a visual effect is created by the movement of the light. The body portion preferably is constructed of a material to pass light therethrough, and can be either wholly or partially clear or translucent, or a combination of both. Alternatively or in addition to the light source, the slide body can include an eccentric motor that causes the slide body to vibrate. This vibration, in turn, causes vibration of the guitar strings, or other sting instrument, as the slide is positioned on the strings, or moved along the strings, by the musician.

14 Claims, 8 Drawing Sheets

GUITAR SLIDE

FIELD OF THE INVENTION

This invention relates to musical instruments, and more particularly, to guitar slides having a visual and/or a tactile component powered by an electrical current. The visual component can include a light assembly, such as light emitting diodes, which provides a visual effect during movement of the slide by the musician along the guitar strings. The tactile component can include an eccentric motor which causes the slide itself to vibrate during movement by the musician. This vibration, either alone or with the movement of the entire slide across the guitar strings, causes various sounds as the slide is moved during playing. The guitar slide of the present invention can include both the lighting assembly and the vibrating assembly together.

BACKGROUND OF THE INVENTION

Live musical performances provide both visual stimulation, as well as the obvious sound or audible experiences, to the performer and to the audience. Performers often enhance the visual aspects of their live performance with special, visual effects such as lighting displays, stage effects, and even pyrotechnics. Musical artists also employ various components to change or enhance the sound of the instrument being played. This latter aspect of a musical performance has become especially common with the advent of electrically amplified instruments, such as electrical guitars.

Some musical genres, such as the blues, rock and country music, make use of a unique sound generated by a guitar, in which the musician uses an instrument commonly referred to as a guitar slide to contact the strings along the neck of the guitar with one hand while the strings are being picked or strummed over the guitar body, or the pick ups of an electric guitar. Common guitar slides comprise a tube or cylindrical body portion with a hollow interior that is received over one of the fingers of a musician's hand that holds the guitar neck. In this manner of playing, the guitar slide is used to shorten or lengthen the effective vibratory length of the strings, thus changing the sounds emitted. The guitar slide is most often moved either slowly or quickly along the neck toward or away from the guitar body to change the sounds, as desired.

SUMMARY OF THE INVENTION

The present invention is directed to a guitar slide comprising a slide body that is preferably cylindrical, having a smooth, continuously curved outer wall that defines a central channel or bore, sized to accommodate a finger. In the embodiment of the invention that is directed solely to the visual component, a lighting assembly is attached to the slide body at one end. The slide body can be made of any rigid material, but preferably is comprised of a hard plastic or glass through which light may pass. The lighting assembly includes a contact ring that is approximately the same diameter as the tubular slide body. The contact ring supports one or more lights, such as light emitting diodes (LEDs) that emit light when powered by an electrical current. In a preferred embodiment, several LEDs are provided in order to emit enough light to achieve the desired visual effect, that is, so that the lights of the guitar slide are visually apparent to both the musician and persons watching the performance. An electrical switch that is powered by a small battery, such as the coin shaped, 3 volt lithium batteries commonly used to power watches, delivers power selectively to the lighting assembly.

Another embodiment of the present invention is directed to a guitar slide having a miniature, vibrating motor instead of the lighting assembly referenced above. In this second embodiment, a slide body, similar to the tubular slide of the first embodiment, is provided, but includes end wall at one end of the cylindrical body that defines a channel recessed therein. In this embodiment, the body also is made of rigid material, including plastic, but preferably is made of metal, such as stainless steel, brass or copper. A small motor which rotates a shaft is affixed to the end wall, being positioned in the channel. A weight is mounted eccentrically on the shaft, so that the motor vibrates by the action of the spinning eccentric mass or weight as the shaft is current. Such vibrating motors are well known, and are used for example in common devices such as cell phones and video gaming controls. An electrical switch is connected to the motor in order to selectively turn the motor "on" and "off", as desired. The motor is powered by a coin-shaped, 3 volt lithium batter, as described above. When the guitar is played by the musician, the vibrations of the slide against the guitar string along the neck produces unique sounds.

In a third embodiment, a guitar slide is provided having both the lighting assembly and the vibrating assembly, in order to combine the effects of visual and auditory effects.

DETAILED DESCRIPTION OF THE PREFERRED EMBODIMENTS

Figure 1:
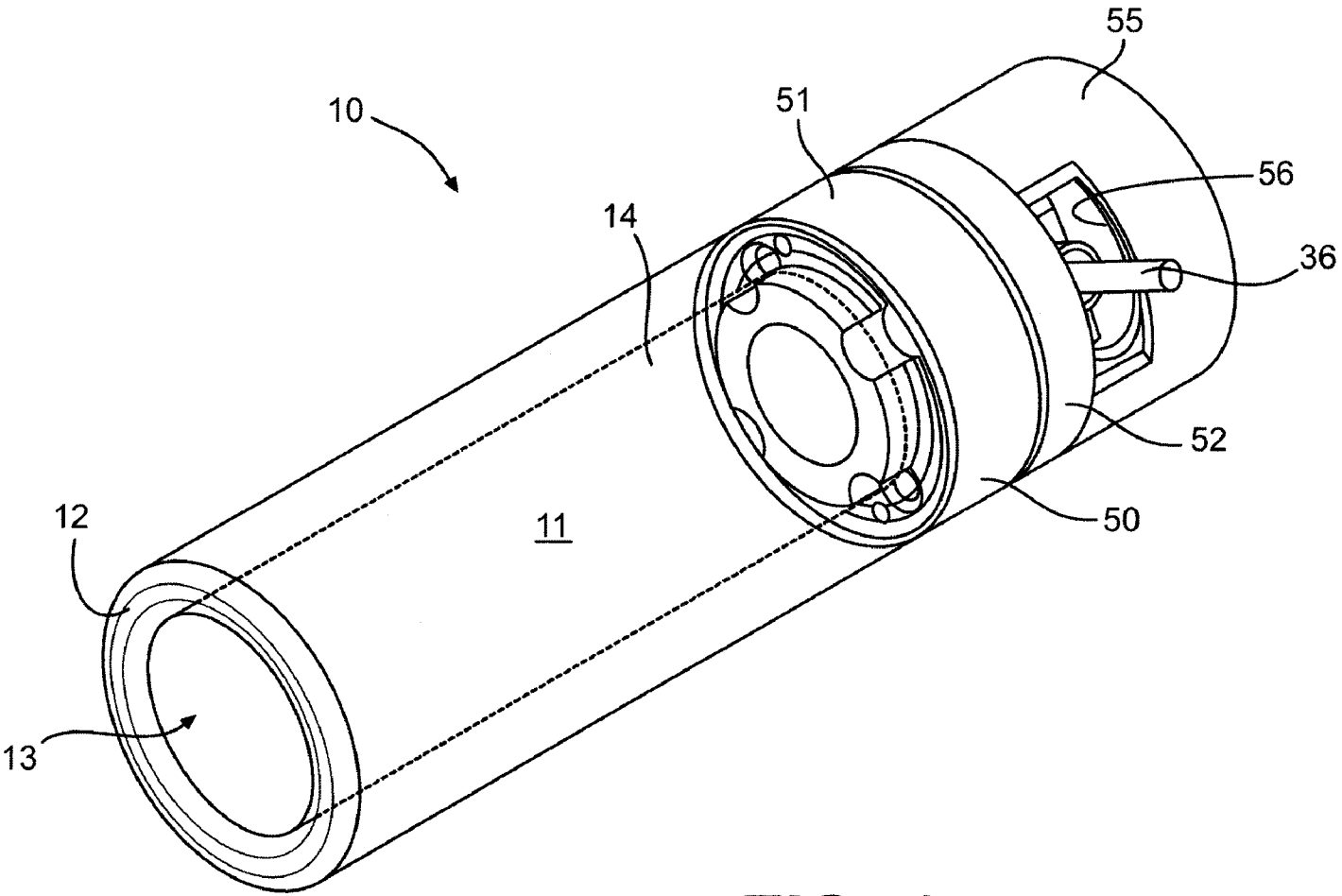
FIG. 1 is a perspective view of a guitar slide of the present invention that includes a lighting assembly.
Figure 2:
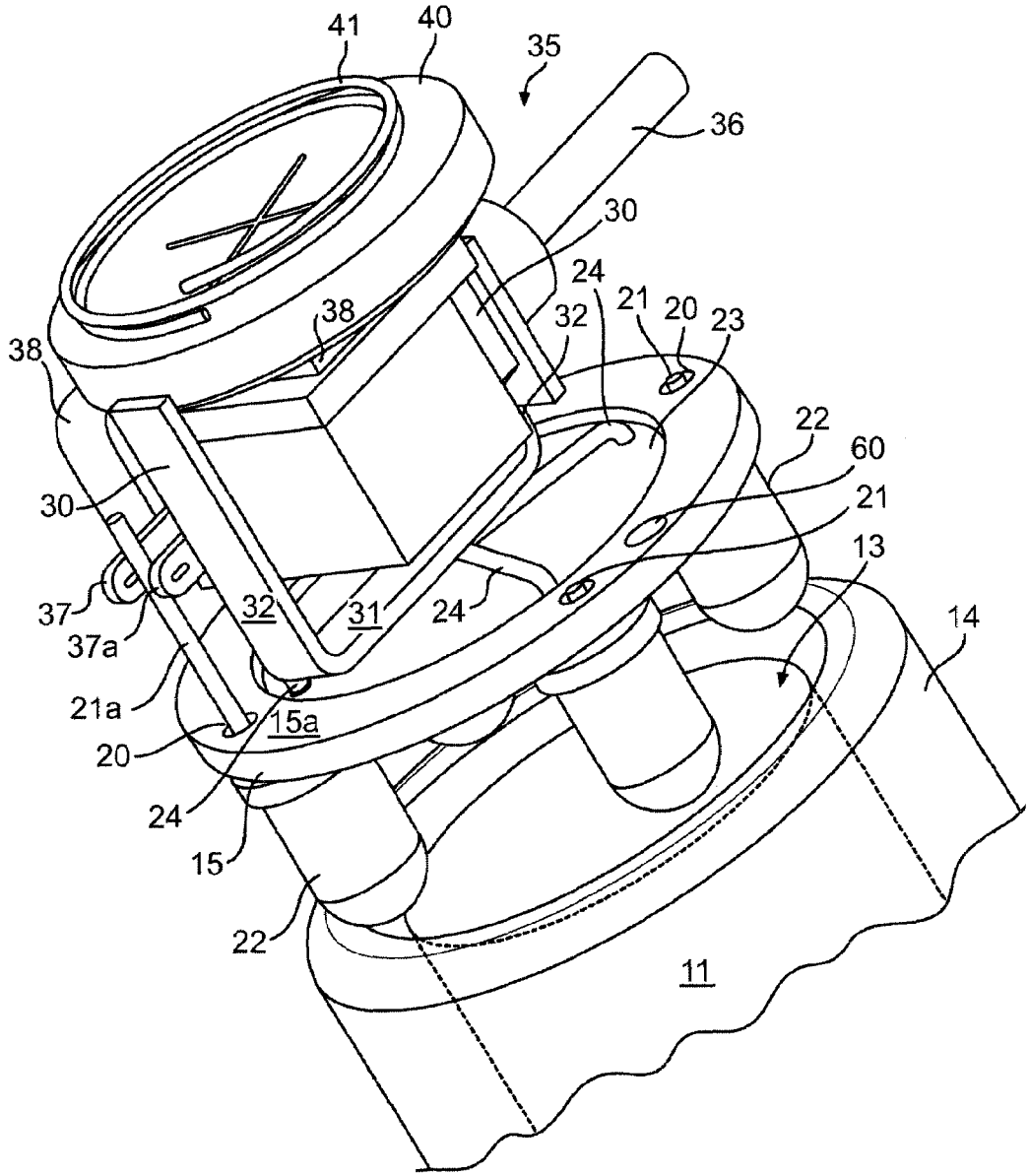
FIG. 2 is a partially exploded view of the guitar slide of FIG. 1.
Figure 4:
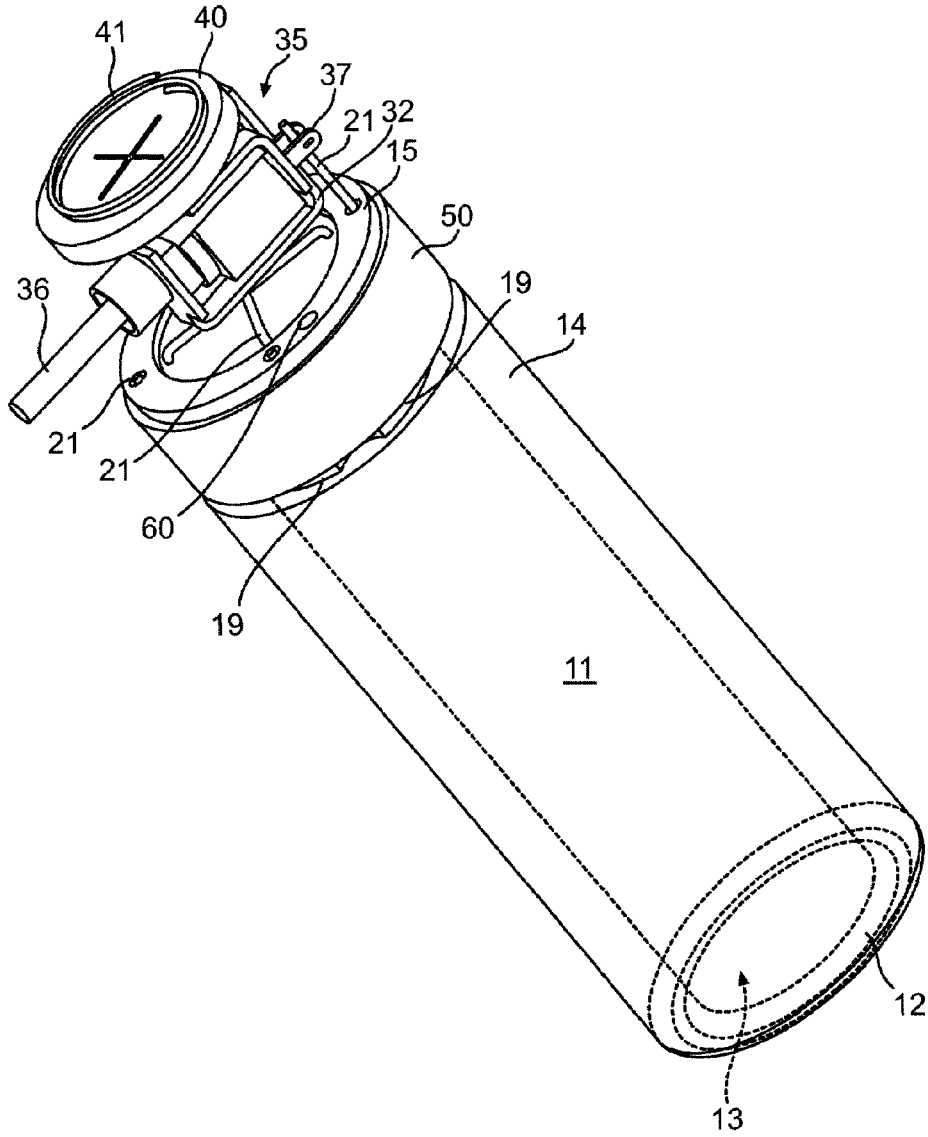
FIG. 4 is a perspective view of the guitar slide of FIG. 3.

FIG. 1 shows guitar slide 10 having a slide body 11 having a cylindrical side wall 12 that defines a bore or channel 13, therethrough. The outer surface or wall 14 of body 11 is smooth and circular in shape. Body 11 can be made of any transparent or translucent material, such as glass or plastics such as polyethylene, polyvinylchloride, or polystyrene, such that light can pass through side wall 12. The size of the diameter of bore 13 can be selected so that can be easily slid onto a finger of the musician, and stay in place while being played, but also is easily removed. A base or ring 15 is received at one end of the slide body 11. The base 15 is ring-shaped and dimensioned so that its outer wall 16 is the same diameter as the outer wall 14 of slide body 11. Flanges 19 (FIG. 4) project from one side of the ring 15, and are received into the bore 13 of the slide in a mechanical "snap fit" fashion, to secure the ring 15 to the slide body 11. Base 15 defines spaced holes therethrough such as holes 20. Below each hole 20 is mounted a separate light emitting diode (LED). Each LED has two electrical wires or contacts extending therefrom, a positive contact and a negative contact. The negative contact, such as contacts 21, extends into hole 20 and is soldered to ring 15, in order to firmly mount LED 22 to ring 15. As shown in FIG. 2, all but one such contact 21 is cut so that it does not extend beyond the upper surface 15*a* of ring 15. An insulator 23, made of any electrically insulating material such as rubber, plastic, or paperboard, is fixed to the underside or bottom (not shown) of ring 15. Positive contacts 24 extending upwardly from LEDs 22 and through insulator 23 are bent in an L-shape, as shown in FIG. 2. The positive contacts extend toward the middle portion of disk-shaped insulator 23. A switch holder 30 is mounted by, for example, soldering two positive contacts 24. Switch holder 30 is U-shaped, and includes a lower arm portion 31 and two upwardly extending arms 32, thus forming a positive contact element, which is in electrical contact with contact 24. An electrical switch 35 is mounted to switch holder 30. Switch 35 can be any commonly known electrical switch suitable for turning on and off LEDs 22 by moving an actuator or post 36 to either the "on" or "off" positions, respectively. Switch terminals 37 extend from the opposite side of switch 35, and form the negative contacts for switch 35. One of the negative contacts 21*a* of LEDs 22 extends above the upper surface 15*a* of ring 15, and is in electrical contact with contact 37*a* of switch 35 as shown in FIG. 2. Switch 35 also includes negative contact 38, which is in electrical contact, such as by soldering, to contact 37. A battery 40, such as a common 3 volt, coin-shaped lithium battery commonly used in watches and other timepieces, rests with its negative side upon negative contact 38. In this orientation, the positive side of battery 40 will extend away from switch 35. A spring 41 is positioned on top of battery 40, and keeps battery in physical contact with switch 35, as discussed herein.

Figure 3:
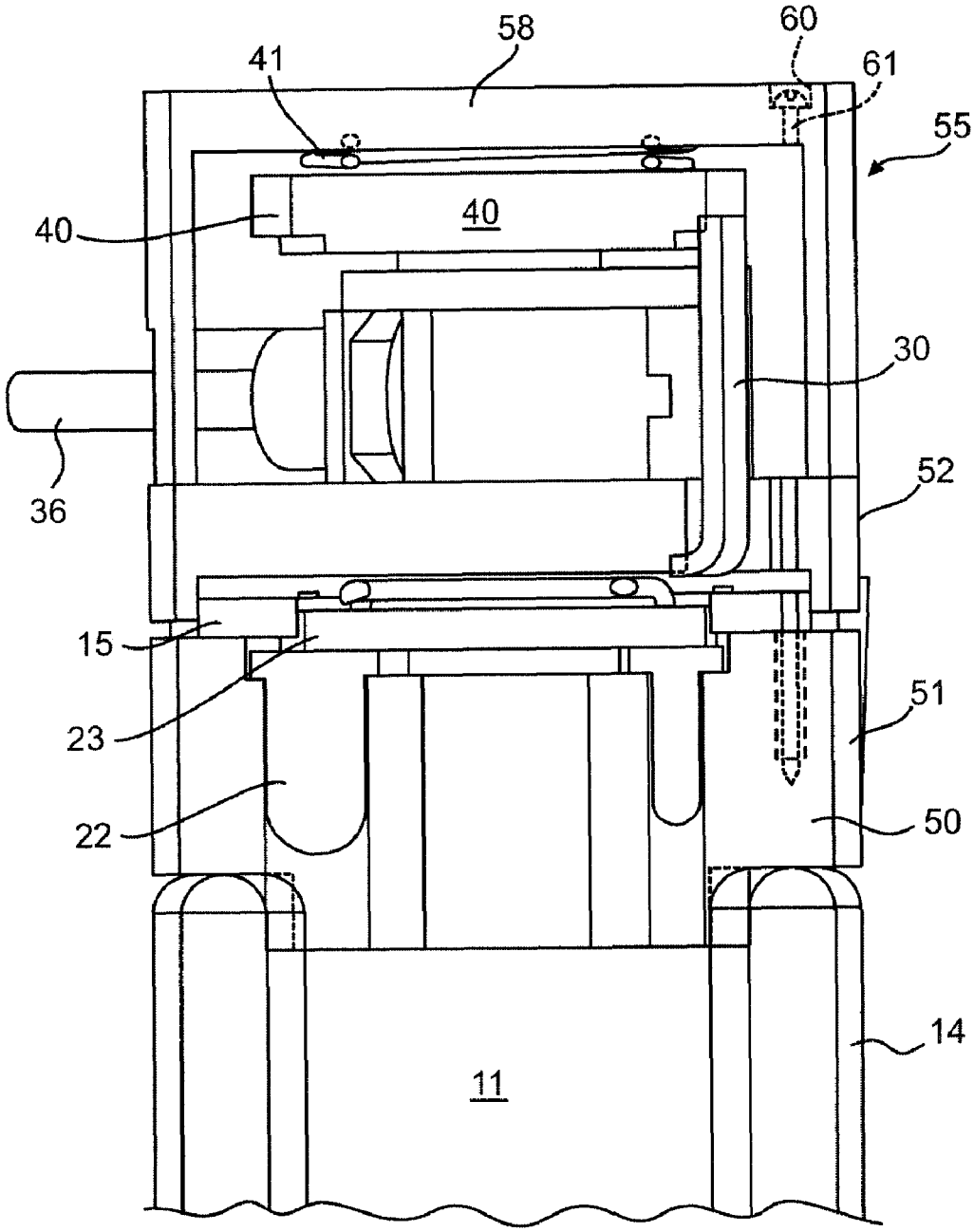
FIG. 3 is a partial cross-sectional view of the guitar slide of FIG. 2.

A base cover 50 is received around ring 15 and LEDs 22, as shown in FIG. 1, to cover and protect LEDs 22. The outer side wall 51 of base cover 50 is dimensioned identically to the side wall 14 of slide body 11, so that side wall 51 is coincident to side wall 14. A second circular cover 52 is position adjacent to cover 50, as shown in FIG. 1. An end cap 55 is positioned adjacent to ring 52 to cover switch 35. End cap 55 includes a rectangular-shaped cutout section 56, through which extends actuator or post 36 of switch 35, so that post 36 can be moved manually to "on" and "off" positions, respectively. Cover 55 includes an end wall 58 (FIG. 3) that serves as a compression surface for spring 41, so that battery 40 is maintained in contact with switch 35. Two elongate bores 60 extend through cover 55, ring 52, and cover 51 opposite to one another. The side wall (not shown) of bore 60 is threaded, and a pin 61 extends through bore 60, so that when tightened, cover 55, ring 52, and cover 51 are held firmly together as a single unit by the pins 61. When the guitar slide 10 is assembled and turned on, the LED's 22 are illuminated, and send light through the translucent (either clear or opaque) side wall 12. Therefore, a visual light effect is created. As the musician moves the slide up and down the guitar neck, the visual effect to the musician or to observers is enhanced, creating a unique and pleasing visual effect.

Figure 5:
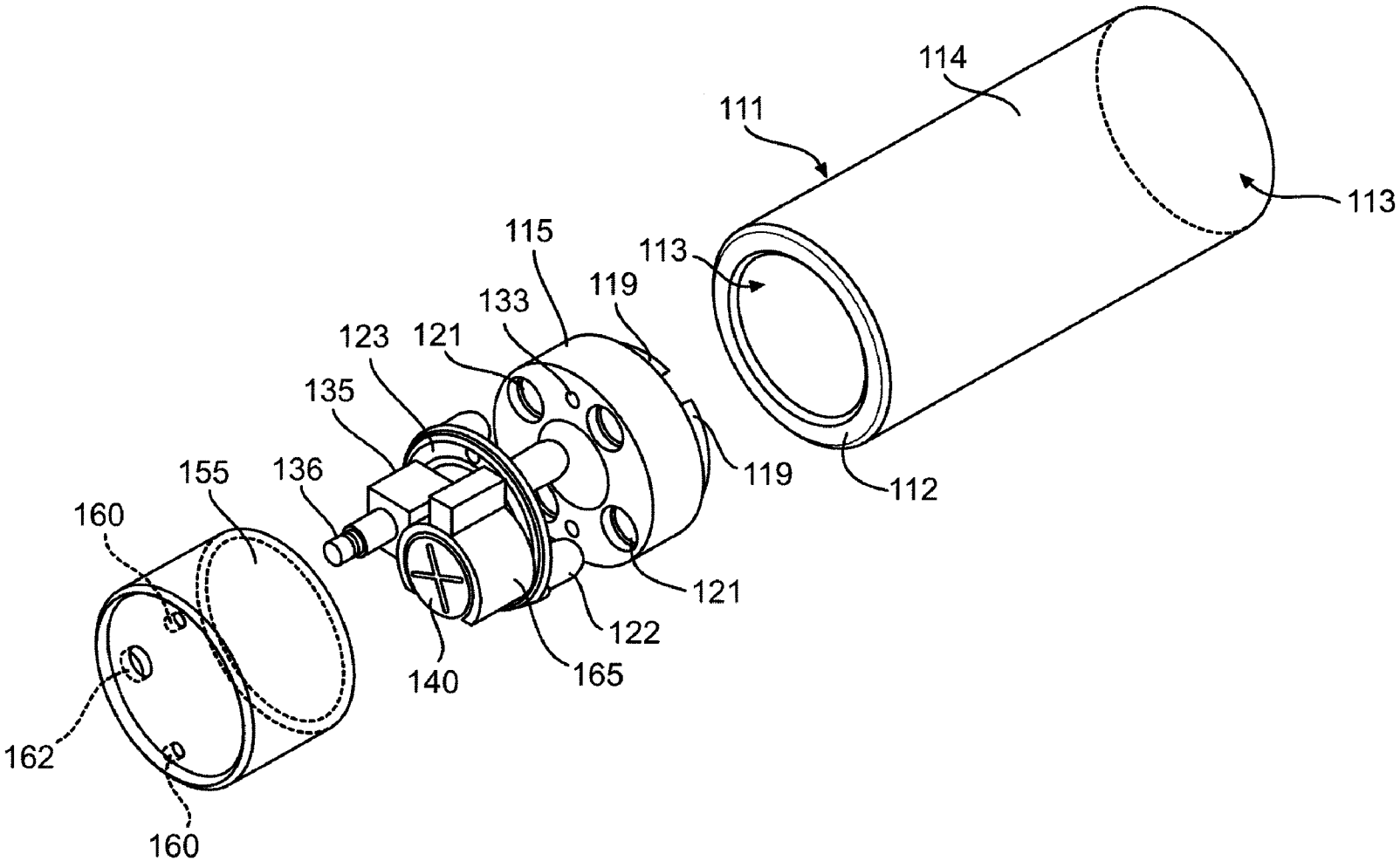
FIG. 5 is an exploded perspective view of another guitar slide having a lighting assembly.

Another embodiment of the present invention is shown in FIG. 5. This second embodiment includes a slide body 111 that is cylindrically-shaped, and including side wall 112 defining a bore 113 therethrough. The side wall 112 includes a smooth, curved outer surface 114. A base or LED holder 115 as shown in FIG. 5 includes flanges 119 along one side that are sized to mechanically snap fit LED holder 115 to slide body 111. Holder 115 defines holes 121 formed therethrough. In this embodiment, LEDs 122 extend into and through holes 121, toward slide body 111, so that light emitted therefrom extends into the slide body. Holder 115 also defines internally threaded holes 133 which, as discussed below, receive a pin for mounting purposes. The LEDs 122 are mounted to a circuit board 123. As well known in the art, circuit board 123 is printed with the necessary circuits to allow switch 135, which is similar in structure and function to switch 35, to turn LEDs 122 on and off. A battery holder 165, which can be formed of plastic or other such non-conductive material, is attached to circuit board 123. A battery 140 is received in holder 165, to power LEDs 122 on when switch 135 is turned to its "on" position by pressing button 136. A top cap 155 defines two bores 160 through which pins (not shown) extend. Therefore, the pins 160 extend through cap 155, circuit board 123, and into bore or holes 133 of holder 115. When pins 160 are tightened, cap 155 is mechanically fixed to base 155 and therefore to slide body 111. Cap 155 also defines hole 162, through which button or hole 136 of switch 135 extends, so that button or post 136 can be actuated to turn switch 135 to either "on" or "off" positioned respectively. Therefore this second embodiment is nearly identical to the first embodiment discussed above in structure and function, except principally that it includes a printed circuit board that delivers current from the battery to the LED's, instead of using the pins or contacts 21*m* 21*a* and 24 of the first embodiment.

Figure 6:
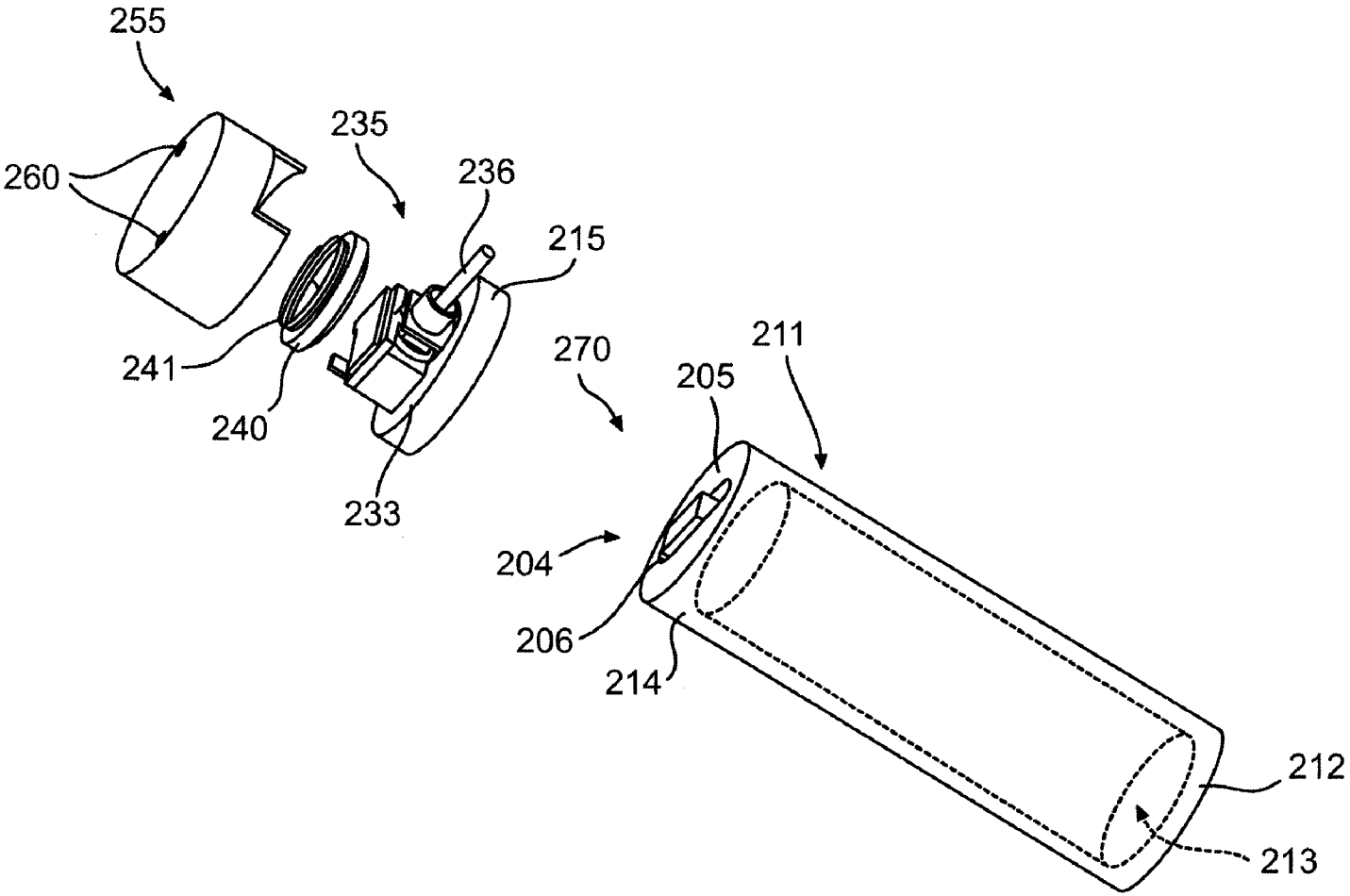
FIG. 6 is an exploded perspective view of another guitar slide that includes a vibrating motor.

A third embodiment of the present invention is designed to impart vibration to the slide body, instead of providing a visual or lighting effect. In this third embodiment, a tubular or cylindrical slide body 211 includes side wall 212 that defines an internal bore 213 therethrough. Bore 213, however, does not extend from end to end of slide body 211 as in the previous embodiments. Bore 213 is open at one end, but closed at the opposing end. End portion 204 includes end wall 205 that effectively closes one end of body 211 so that bore 213 does not extend through closed end wall 205, as shown in FIG. 6. The end wall 205 defines a space, or channel, 206 therein. A vibrating motor 270 is received in channel 206, and mechanically mounted by pins, glue, mechanical fit or other suitable manner to end wall 205 of slide body 21 so that as vibrating motor 270 vibrates, the entire slide body 211 will vibrate at the same frequency as the motor. Motor 270 can be of any vibrating motor well known, to include eccentric mass type vibrating motors that are used in, for example, cellular telephones to cause the cellphone to vibrate when a call is received, or as commonly used in video game controllers.

Figure 7:
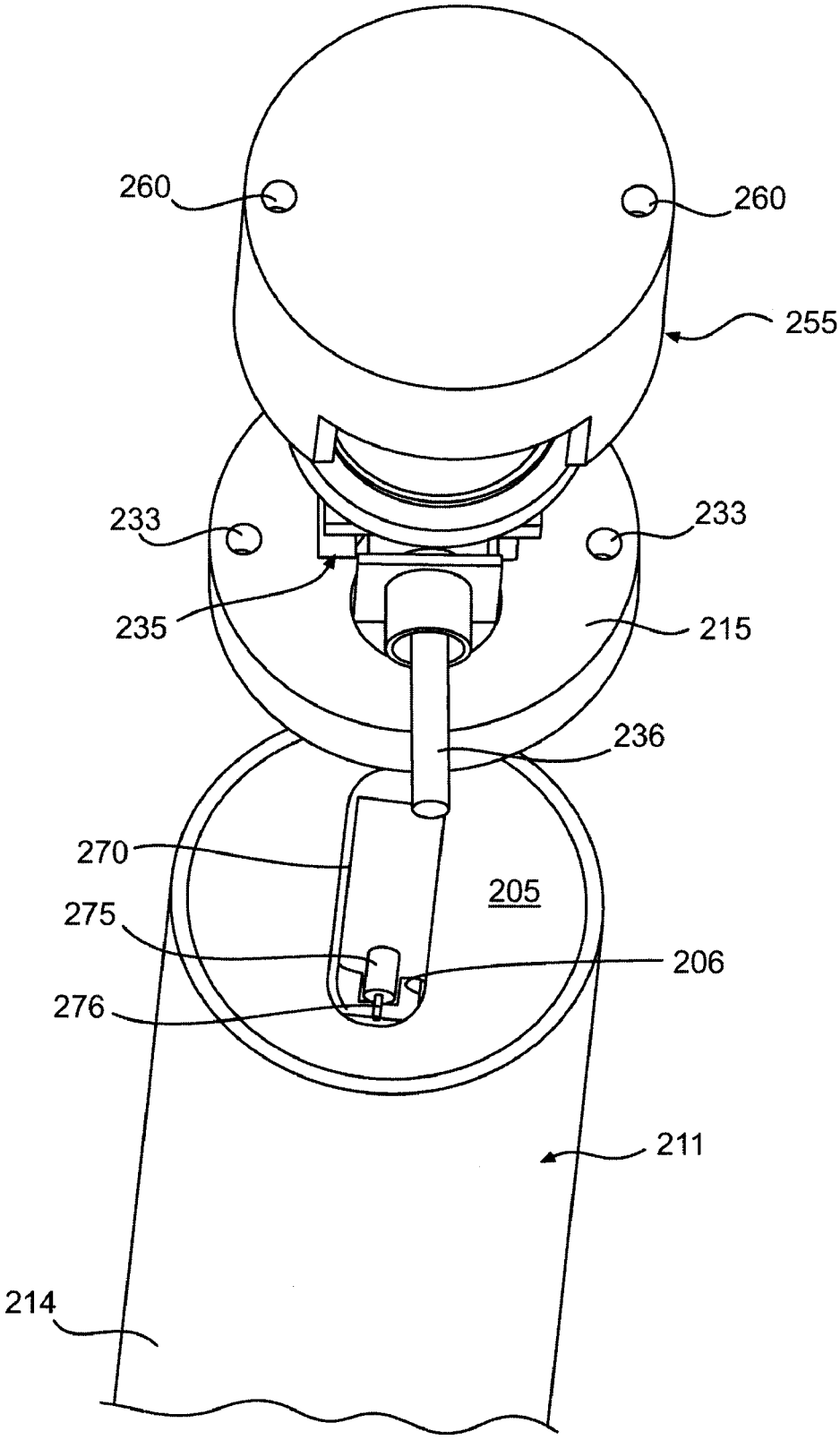
FIG. 7 is an exploded perspective view of the guitar slide of FIG. 6.

The remaining components, that is electrical connections, circuit board, battery, and covers for this third embodiment of the present invention are identical to those described with respect to the previous embodiments discussed above. These elements include a switch holder 215 which includes either positive or negative contacts or a printed circuit board, as desired. A switch 235 is mounted to holder 215. A battery 240, of the type described above, powers vibrating motor 270 through selective activation of switch 235. A spring 241 compresses battery 240 against switch 236 and cap 255 as discussed above. Pins (not shown) extend through holes 260 defined in cap 255 and into holes 233, which are internally threaded, of holder 215. In this manner, cap 255 is held to holder 215. Holder 215, itself, is held to body 211 by mechanical means, such as being snap fit, or by pins, as desired. FIG. 7 shows slide body 211 and end wall 205 which includes channel 206. Vibrating motor 270 includes rotating, eccentric mass 275 which rotates about shaft 276 which is turned by motor 270.

In use, this third embodiment of the guitar slide vibrates to impart vibration to the guitar strings, principally along the neck of the guitar. When the switch 235 is turned to the "on" position by the musician, current is delivered from battery 240 to the vibrating motor 270. The shaft 276 of the motor is caused to rotate, spinning eccentric mass 275. This action causes motor 270, and slide body 211, to vibrate as the same frequency. In use, the musician strums or picks the guitar strings along the guitar body, or the pick ups of an electric guitar with one hand, and selectively moves the slide along the guitar strings along the neck of the guitar with the other hand. This sliding action, combined especially with the vibrating action of the vibrating guitar slide, causes a unique and pleasing sound, by a talented musician.

Figure 8:
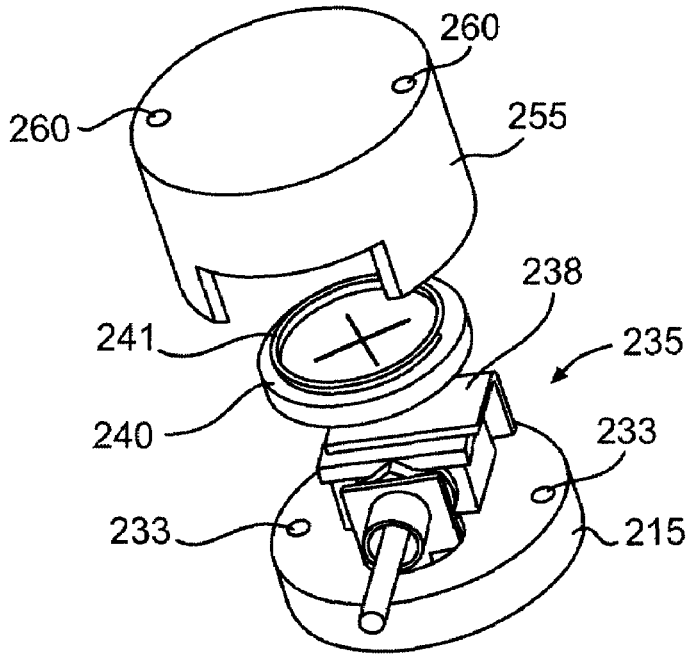
FIG. 8 is another exploded perspective view of the guitar slide of FIG. 7.
Figure 8:
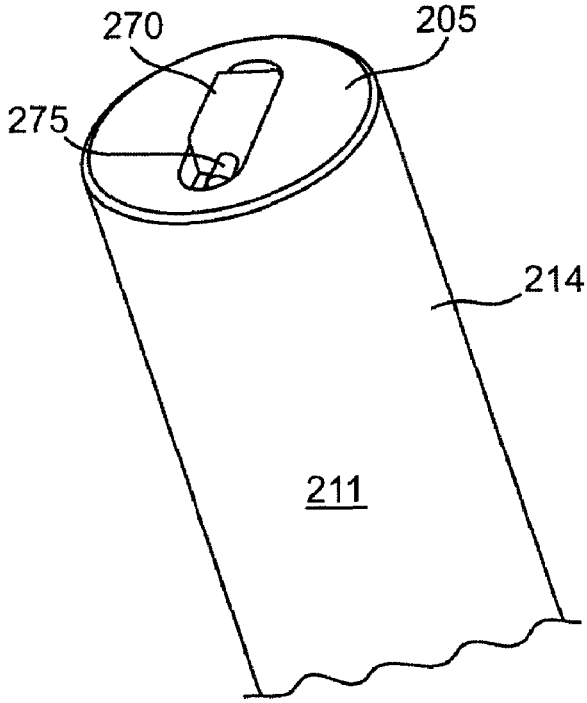

In a fourth embodiment, the lighting assembly and the vibrating motor assembly are combined, to produce a lighted guitar slide that also vibrates. In this embodiment of the present invention, the slide is comprised of either translucent plastic, or of metal with plastic windows. An end cap, such as end cap 205, is provided as shown in FIG. 7, but holes (not shown) are arranges through end cap 205 that receive LED's (not shown). Therefore, the embodiment of FIGS. 6 through 8 is modified to include LED's, in order to provide both the visual and auditory effects discussed above.

It will further be obvious to those skilled in the art that many variations may be made in the above embodiments here chosen for the purpose of illustrating the present invention, and full result may be had to the doctrine of equivalents without departing from the scope of the present invention, as defined by the appended claims.

I claim:

1. A guitar slide comprising:

an elongate slide body defining an outer wall, the slide body also defining an inner chamber sized and shaped to receive a finger of a user, for manual movement along the strings of a guitar as the strings vibrate, the slide body applied to a string to produce sound;

a light source attached to said slide body, said light source comprising at least one light emitting diode and being positioned and oriented to illuminate a portion of said slide body; a battery coupled to said light emitting diode to provide current to said diode, wherein said at least one light emitting diode is positioned to project light into the inner chamber defined by said slide body.

2. A guitar slide as claimed in claim 1 and further comprising a switch coupled to said battery and said light emitting diode for selectively illuminating said light emitting diode.

3. A guitar slide as claimed in claim 1 and wherein said slide body is generally elongated in shape having first and second end portions.

4. A guitar slide as claimed in claim 3 and wherein said at least one light emitting diode is positioned at one end portion of said slide body.

5. A guitar slide as claimed in claim 4 and wherein said slide body is either translucent or transparent.

6. A guitar slide as claimed in claim 5 and further comprising an LED holder mounted on the one end portion of said slide body, said at least one light emitting diode being disposed in said LED holder.

7. A guitar slide as claimed in claim 6 and further comprising a switch holder mounted to said LED holder and a battery in said switch holder coupled to said at least one light emitting diode.

8. A guitar slide as claimed in claim 7 and further comprising a switch disposed in said switch holder, said switch coupled to said battery and said at least one light emitting diode for selectively lighting said at least one light emitting diode.

9. A guitar slide comprising a slide body having an interior passageway sized to receive a finger of a musician and a light source on said slide body, a power source electrically connected to said light source for providing current to said light source, a switch electrically coupled to said power source for selectively switching the current to said light source, said light source being positioned and arranged to illuminate at least a portion of said slide body upon activation of said light source, said slide body being applied to a guitar string to produce sound.

10. A guitar slide as claimed in claim 9 and wherein said power source comprises a battery mounted on said slide body.

11. A guitar slide as claimed in claim 9 and wherein said slide body has an at least partially translucent portion, said light source, when activated, projecting light into said at least partially translucent portion.

12. A guitar slide as claimed in claim 11 and wherein said slide body is entirely translucent.

13. A guitar slide as claimed in claim 9 and wherein said slide body has an at least partially transparent portion, said light source, when activated, projecting light into said at least partially transparent portion.

14. A guitar slide as claimed in claimed in claim 9 and further comprising a control circuit for flashing said light source at predetermined rates.

* * * * *